United States Patent [19]

Ortwein

[11] Patent Number: 4,696,429

[45] Date of Patent: Sep. 29, 1987

[54] ELASTIC MAT FOR A BALLAST BED UNDERLAYMENT

[75] Inventor: Hermann Ortwein, Cologne, Fed. Rep. of Germany

[73] Assignee: Clouth Gummiwerke Aktiengesellschaft, Cologne, Fed. Rep. of Germany

[21] Appl. No.: 754,029

[22] Filed: Jul. 11, 1985

[30] Foreign Application Priority Data

Jul. 12, 1984 [DE] Fed. Rep. of Germany ..... 3425647

[51] Int. Cl.[4] ..... E01B 2/00; E01B 19/00; E01C 3/06; E01C 5/18

[52] U.S. Cl. ..... 238/2; 238/382; 404/28; 404/71; 405/16; 405/19

[58] Field of Search ..... 405/16, 19; 404/28, 404/71; 238/1, 2; 428/161, 166, 167, 172, 909, 911

[56] References Cited

U.S. PATENT DOCUMENTS 4,302,197 11/1981 Kimura et al. ..... 139/420 R
4,428,698 1/1984 Murphy ..... 404/17
4,487,814 11/1984 Hollaway ..... 428/294
4,500,037 2/1985 Braitsch et al. ..... 238/2
4,556,338 12/1985 Fahey ..... 404/28

FOREIGN PATENT DOCUMENTS 2007834 1/1970 France .
560598 4/1957 Italy ..... 404/28

*Primary Examiner*—James C. Cannon
*Attorney, Agent, or Firm*—Karl F. Ross; Herbert Dubno

[57] ABSTRACT

A mat comprising an elastic material which serves as an underlay for a ballast bed of crushed stone, metallic particles, or the like is provided with a plurality of projections on its underside and with an upper layer of a material different from the elastic material. This upper layer on the upper side of the mat advantageously comprises a strong fabric. Particularly the upper layer may comprise a multilayered fabric with inlay layers of elastic material positioned between the individual layers of the multilayer fabric as well as a coverying layer of a softer material on the upper surface of the upper layer of the mat. The fabric of the upper layer of the mat advantageously comprises a water and rot resistant plastic material, such as a polyamide.

21 Claims, 9 Drawing Figures

ELASTIC MAT FOR A BALLAST BED UNDERLAYMENT

FIELD OF THE INVENTION

My invention relates to an improved elastic mat and, more particularly, to a mat comprising an elastic material which serves as an underlayment for a ballast bed of crushed stone, gravel, metallic particles or the like.

BACKGROUND OF THE INVENTION

Mats of an elastic material and provided on their undersides with projections can be used as a support layer for a bed of ballast in railway or highway applications.

These mats can be provided with a layer on their upper side, which comprises a material different from that of the rest of the mat and serving to limit ballast movement. They serve the ballast bed and the track by providing an elastic, cushioning layer on the ground, on the tunnel and trough walls according to the application, in order to effect sound damping or attenuation of sound conduction.

In known mats of the foregoing kind the upper side of the mat can be provided with a layer of a plastically deformable material as taught in German Patent document DE-GM No. 80 13 779, for example, a bituminous layer.

The ballast bed stone can penetrate to a certain extent into this layer, so that an extended antiskid or antislide layer is the result. A disadvantage of this kind of mat, however, is that the ballast, i.e. crushed stone, gravel, metallic particles, or the like, with sharp edges penetrates through the mat in a comparatively short time, whereby the mats are destroyed, so that finally all that is left is a granular bed or granulated remnant of the mat. Such a granulated remnant provides little or no acoustic damping or insulation.

Another known form of mat has a sheet-metal layer on its upper side as taught in German Patent document DE-OS No. 31 21 946 (see U.S. Pat. No. 4,500,037), which prevents the penetration of the ballast of crushed stone, metallic particles or the like into the mat. These mats provide a particularly high degree of acoustic damping and insulation; they are however only limitedly bendable or flexible, so that they can only extend over very short distances at the place where they are to be installed and a large number must be assembled at high labor cost.

OBJECTS OF THE INVENTION

It is an object of my invention to provide an improved mat for use as an underlayment for a bed of ballast, e.g. crushed stone, gravel and metallic particles.

It is another object of my invention to provide an improved mat underlayment for a bed of ballast which will not be gradually pulverized by the ballast, but will act for long periods to damp or insulate sounds propagated through and in the ground.

It is also an object of my invention to provide an improved mat for a bed of ballast which effectively damps or insulates sound propagation and is not inflexible so that it can be rolled up and transported conveniently to the place where it is to be installed, and which will not be gradually pulverized when installed and thus gradually lose its sound deadening properties.

SUMMARY OF THE INVENTION

These objects and others which will become apparent hereinafter are attained in accordance with my invention in a mat of an elastic material and serving as an underlay of a ballast bed of crushed stone, gravel, metallic particles, or the like. The underside of this type of mat is advantageously provided with a plurality of projections and the upper side is provided with an upper layer of a material different from the above mentioned elastic material.

According to my invention the upper layer comprises a high-strength fabric.

In various preferred embodiments of my invention the strong fabric of the upper layer is a water and rot resistant plastic (synthetic-resin) material, particularly a polyamide, and may contain steel wire threads, a cabled-cord fabric, or a fabric containing spikelike, stalklike components, i.e. a fabric woven from rods or bars, or a steel mesh or weave of steel fibers.

The selection of the fabric upper layer provided on the upper side of the mat within the parameters of the invention allows a control and adjustment, particularly a lowering, of the acoustic amplification factor at the resonance frequency. The frequency response may be adjusted by appropriate choice of the type and arrangement of the fabrics in the upper layer of the mat. Thus a damping and insulation of the sound conducted through the earth can be provided by the mat.

According to a feature of my invention the upper layer contains a multilayered fabric having a plurality of individual layers with at least one inlay layer between these individual layers. Advantageously this inlay layer is of an elastic material.

In yet another feature of my invention at least two inlay layers each comprising an elastic material different from each other are provided.

Furthermore a covering layer can be positioned on the upper side of the upper layer comprising a soft material having a high notch impact strength. Advantageously the covering layer has a Shore hardness of no more than 60°, and its thickness is about half the sum of the thickness of each of the inlay layers.

The surfaces of the mat and on the projections can be patterned. The projections can be either trapezoidal in cross section, truncated cones, or cylindrical posts. Furthermore these projections can be staggered with respect to each other and have different heights.

In an especially preferred embodiment of my invention the mat preferably comprises a plurality of mat segments and under the boundary or seam between at least two adjacent mat segments a sectional member is positioned whose shape fits the intervening space between the mat segments. Furthermore instead of a sectional member an elastic strip can be positioned under the boundary between the adjacent mat segments. This elastic strip has a plurality of recesses, which correspond in shape and size to the projections of the mat segments.

BRIEF DESCRIPTION OF THE DRAWING

The above and other objects, features and advantages of my invention will become more readily apparent from the following description, reference being made to the accompanying drawing in which.

SPECIFIC DESCRIPTION

Figure 1:
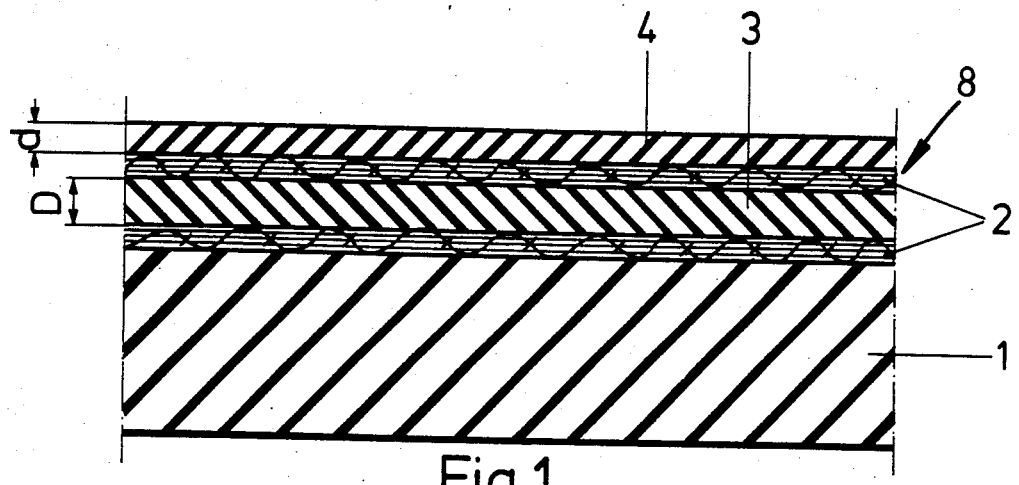
FIG. 1 is a cross-sectional view of a portion of a preferred embodiment of a mat according to my invention.
Figure 4:
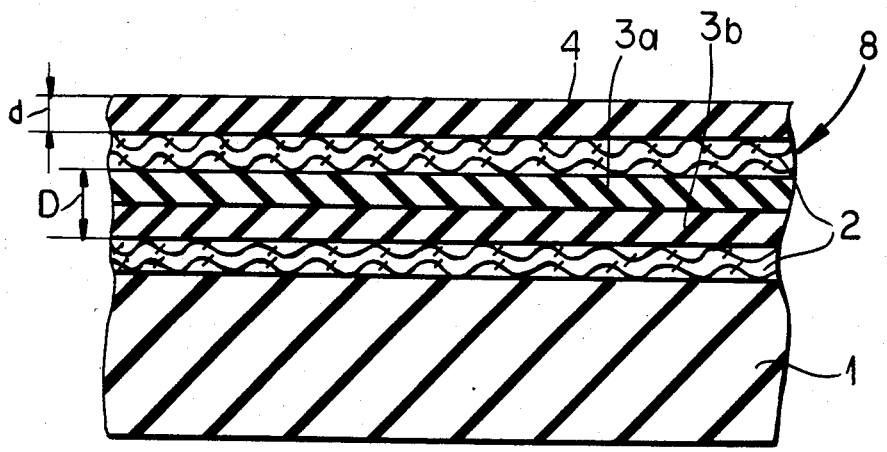
FIG. 4 is a cross-sectional view of a portion of another embodiment of a mat according to my invention.

The mat 1 shown in FIG. 1 is provided on its upper side with an upper layer 8 comprising a two-layered fabric 2, wherein between the two individual layers of the multilayered fabric 2 an inlay layer 3 of an elastic material is provided. Above the two-layered fabric 2 is a covering layer 4, whose thickness d is about half the thickness D of the inlay layer 3. In FIG. 4 a similar structure for the upper layer 8 is shown comprising a two-layered fabric 2 with a covering layer 4, but also with two inlay layers 3*a* and 3*b*. These inlay layers 3*a* and 3*b* are each of a different elastic material. The fabric can be a woven nylon and the elastic materials of the layers 4, 3*a*, 3*b* and 1 can be rubber with or without reinforcing cords.

Figure 2:
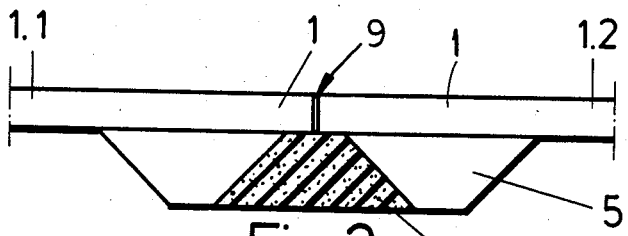
FIGS. 2 and 3 are front elevational views showing a boundary between two mat segments in two embodiments according to my invention.
Figure 3:
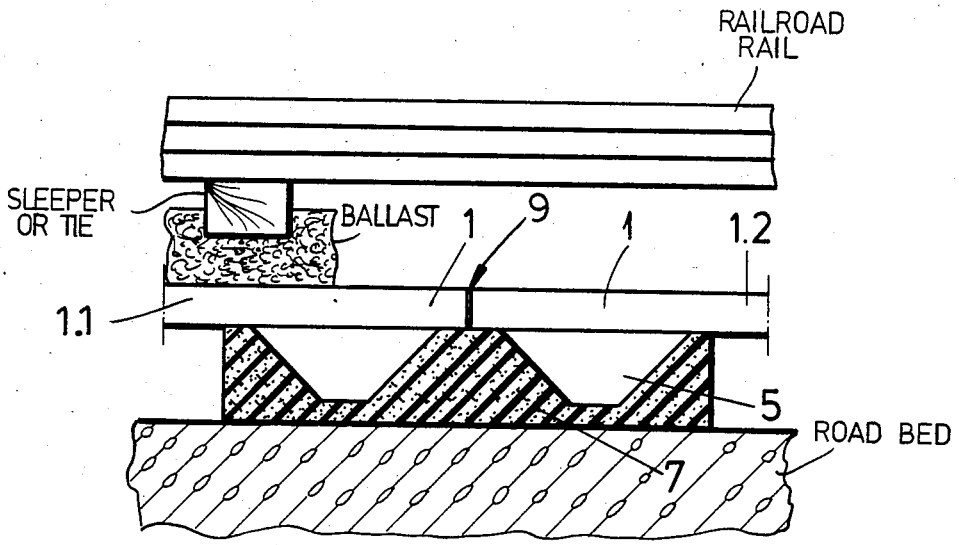

In the embodiments shown in FIGS. 2 and 3 the mat 1 comprises a plurality of mat segments 1.1, 1.2 and so forth and is provided with projections 5 on the underside of the mat segments 1.1 and 1.2. Under the boundary 9 between the partially shown mat segments 1.1 and 1.2 in the embodiment of FIG. 2 a sectional member 6 and in the embodiment of FIG. 3 an elastic strip 7 is positioned so as to engage or fit projections 5. To provide a clearer illustration the sectional member 6 and the elastic strip 7 are shown in cross section.

Figure 5:
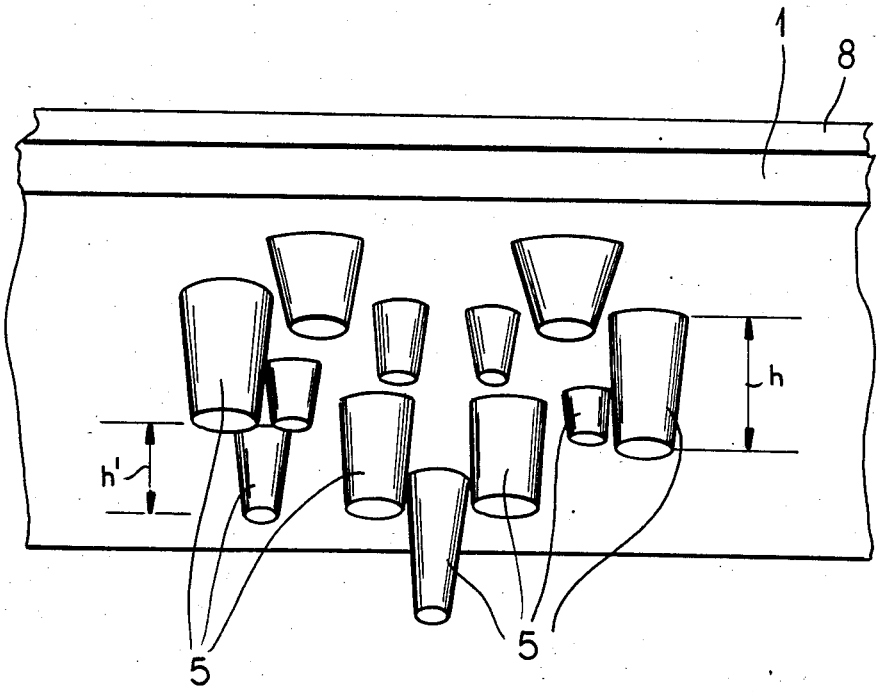
FIGS. 5, 6 and 7 are bottom perspective views of different embodiments of mats according to my invention showing different shapes and arrangements of projections.
Figure 6:
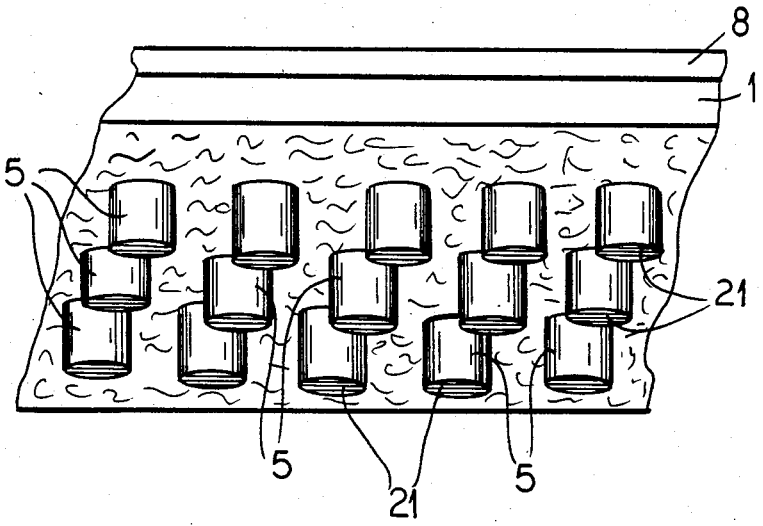
Figure 7:
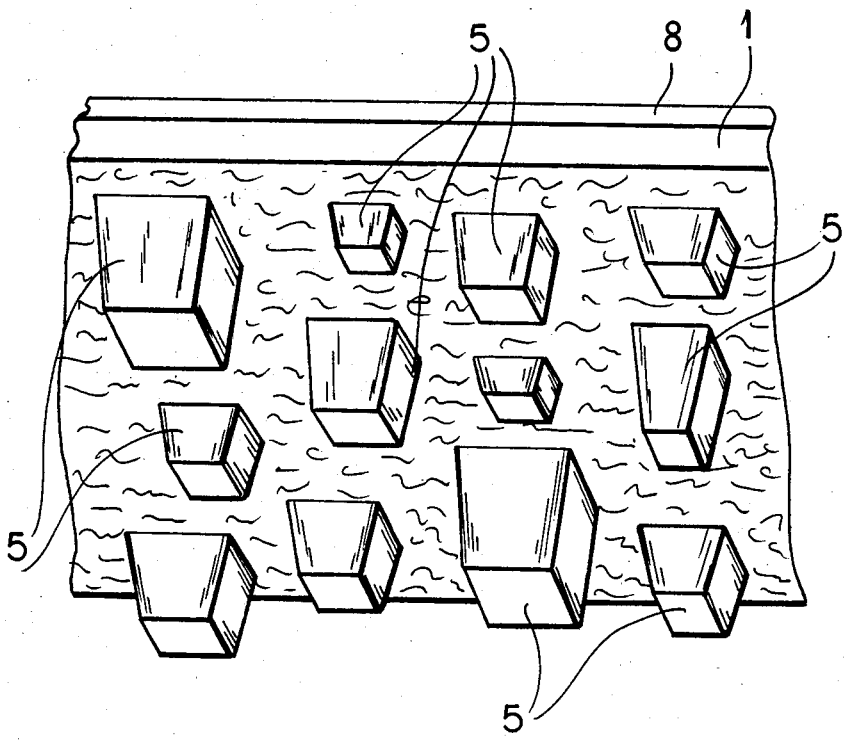

Other examples of the mats according to my invention are distinguished by the shape and arrangement of the projections 5 provided on the underside of the mat. In FIGS. 5, 6 and 7 both staggered and regular arrays of projections are shown. The projections 5 may be truncated cones, cylindrical posts, or trapezoidal members and may have different heights, for example h and h' as shown in FIG. 5.

Figure 8:
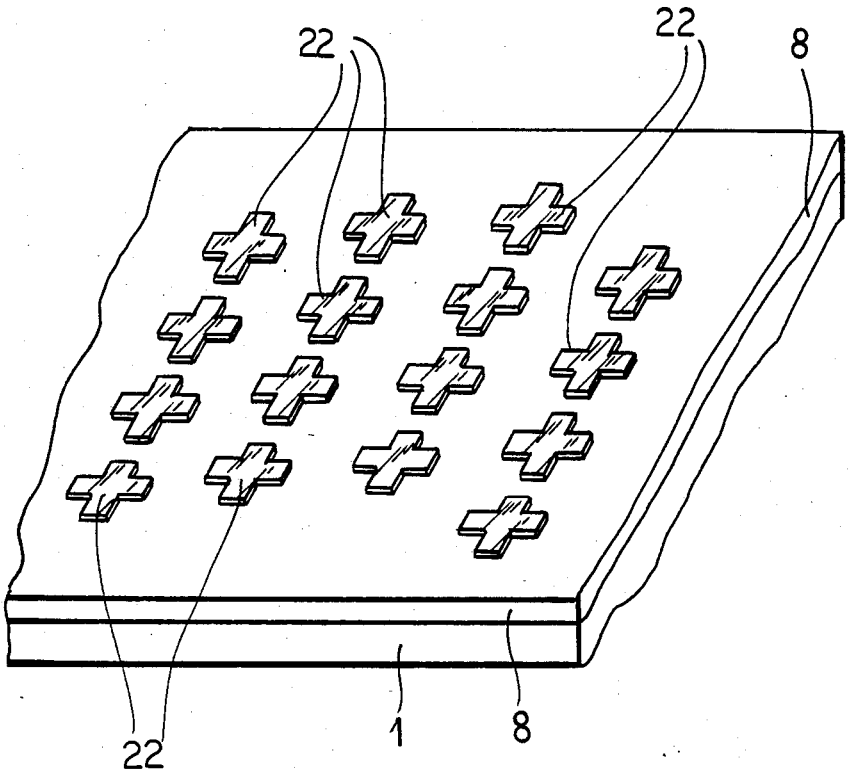
FIG. 8 is a top perspective view of a preferred embodiment of a mat according to my invention showing a pattern on the upper surface of its upper layer.

A first design or pattern 22 may be provided on the upper surface of the upper layer 8 as shown in FIG. 8. A second design or pattern 21 on the upper surface of the projections 5 is also possible as seen in FIG. 6.

Figure 9:
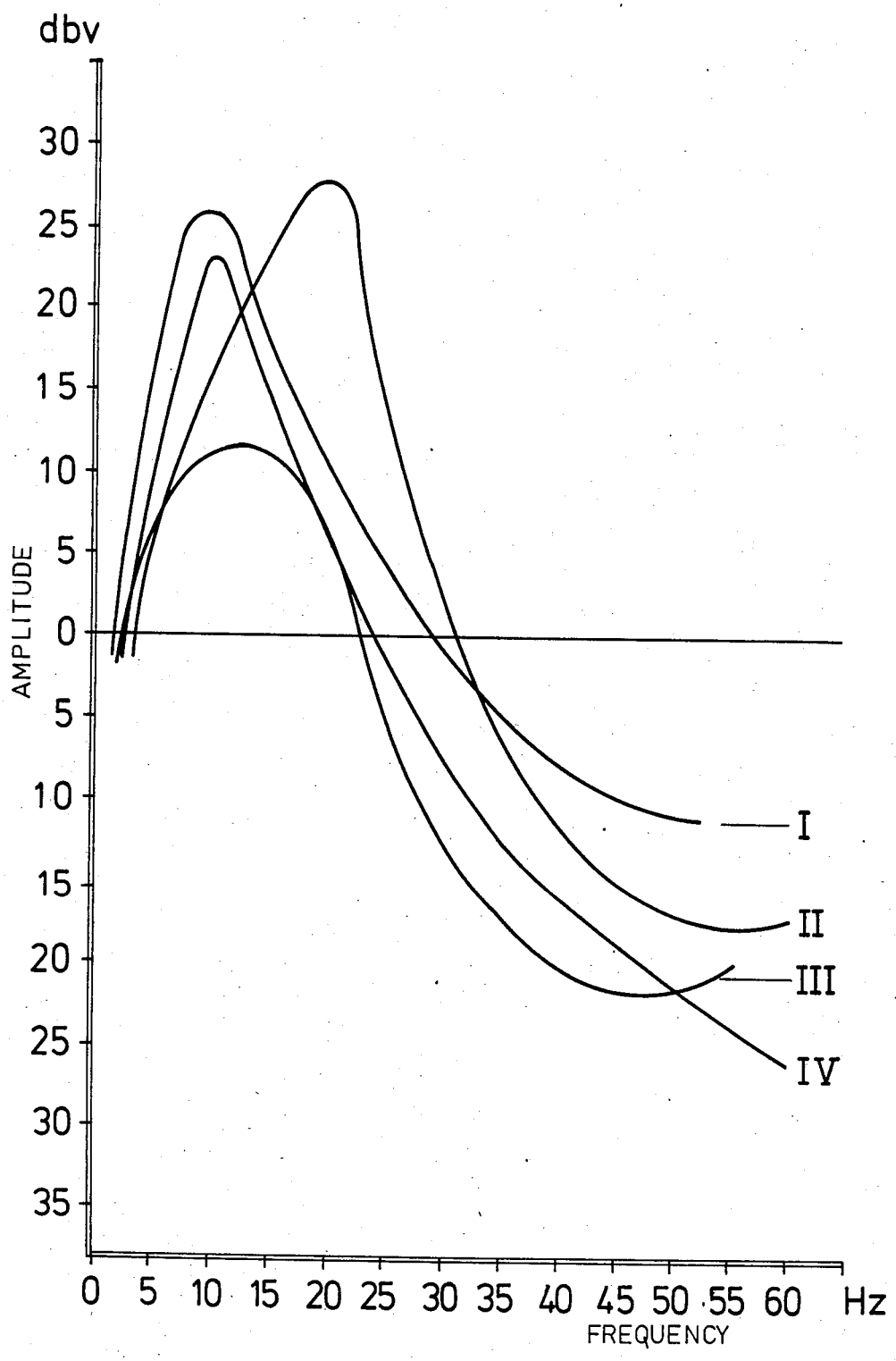
FIG. 9 is a graph or diagram showing the acoustic frequency response characteristics of different mats according to my invention.

From the diagram shown in FIG. 9 one can see that by appropriate selection of different fabrics and spacings between the fabrics the acoustic amplification factor at the resonance frequency can be preset and controlled. Thus curve I shows the acoustic amplification factor at the resonance frequency and associated frequency response curve for a mat with a fabric of increased stiffness; particularly a fabric with spikelike, stalklike components. In such a fabric the resonance frequency is very high. Still higher is the resonance frequency of curve II, which pertains to a mat with a fabric of small tensile strength, for example with an inlay layer 3 of the fabric EP 200. The curve III pertains to a mat with a two-layered fabric EP 200, wherein each fabric layer contacts and lies against each other directly. The curve IV pertains to a mat containing a steel wire fabric of increased tensile strength (@600 kp/mm$^2$).

I claim:

1. The combination with a raillway road bed and a ballast of a ballast-underlayment mat disposed between said bed and said ballast and comprising an elastic body formed on an underside with a plurality of projections and along an upper side with an upper layer of a high-strength fabric exposed to penetrating tendencies of the ballast.

2. The ballast-underlayment mat in the combination defined in claim 1 wherein said high-strength fabric comprises a water resistant and rot resistant plastic material.

3. The ballast-underlayment mat in the combination defined in claim 2 wherein said plastic material is a polyamide.

4. The ballast-underlayment mat in the combination defined in claim 1 wherein said high-strength contains steel wire threads.

5. The ballast-underlayment mat in the combination defined in claim 1 wherein said high-strength fabric is a cabled-cord fabric.

6. The ballast-underlayment mat in the combination defined in claim 1 wherein said high-strength fabric contains spikelike, stalklike components.

7. The ballast-underlayment mat in the combination defined in claim 1 wherein said upper layer comprises a multilayered fabric having a plurality of individual layers.

8. The ballast-underlayment mat in the combination defined in claim 7 wherein between said individual layers of said multilayered fabric at least one inlay layer of an elastic material is provided.

9. The ballast-underlayment mat in the combination defined in claim 8 wherein between said individual layers of said multilayered fabric at least two inlay layers are provided, each of said inlay layers comprising a different elastic material.

10. The ballast-underlayment mat in the combination defined in claim 1 wherein said upper layer has a covering layer positioned on said upper side of said mat comprising a soft material having a high notch impact strength.

11. The ballast-underlayment mat in the combination defined in claim 10 wherein the upper surface of said covering layer has a Shore hardness of no more than 60°.

12. The ballast-underlayment mat in the combination defined in claim 11 wherein said upper layer comprises a multilayered fabric with at least one inlay layer of an elastic material positioned between the individual layers of said multilayered fabric and the thickness of said covering layer is substantially half the sum of the thicknesses of each of said inlay layers.

13. The ballast-underlayment mat in the combination defined in claim 1 wherein the upper surface of said mat is provided with a first design.

14. The ballast-underlayment mat in the combination defined in claim 1 wherein the upper surface of said plurality of said projections provided on said underside of said mat is provided with a second design.

15. The ballast-underlayment mat in the combination defined in claim 1 wherein said plurality of said projections on said underside of said mat are trapezoidal cross section members.

16. The ballast-underlayment mat in the combination defined in claim 1 wherein said plurality of said projections are truncated cones.

17. The ballast-underlayment mat in the combination defined in claim 1 wherein said plurality of said projections on said underside of said mat are cylindrical posts.

18. The ballast-underlayment mat in the combination defined in claim 1 wherein said plurality of said projections on said underside of said mat are staggered with respect to each other.

19. The ballast-underlayment mat in the combination defined in claim 1 wherein said projections have heights which differ from one another.

20. The ballast-underlayment mat in the combination defined in claim 1 wherein said mat comprises a plurality of mat segments and under the boundary between at least two adjacent ones of said plurality of said mat segments a sectional member is positioned, whose shape fits the intervening space between said mat segments.

21. The ballast-underlayment mat in the combination defined in claim 1 wherein said mat comprises a plurality of mat segments and under the boundary between at least two adjacent ones of said plurality of said mat segments an elastic strip is positioned, that is provided with a plurality of recesses, which are positioned so as to correspond to the shape and size of said projections of said mat segments.

* * * * * *